United States Patent [19]

Crawford et al.

[11] 4,398,698

[45] Aug. 16, 1983

[54] FREEFALL WINCH SYSTEM AND METHOD OF OPERATION

[75] Inventors: Steven C. Crawford, Lexington; Thomas J. Feltman, Winchester; Roger A. Steuck, Nicholasville, all of Ky.

[73] Assignee: FMC Corporation, Chicago, Ill.

[21] Appl. No.: 268,315

[22] Filed: May 29, 1981

[51] Int. Cl.[3] ..... B66D 1/08; B66D 5/06

[52] U.S. Cl. ..... 254/291; 254/355; 254/356; 254/361; 254/379

[58] Field of Search ..... 254/290-292, 254/299, 303, 304, 309-310, 314-317, 319, 321-322, 346, 349-350, 355-356, 360-362, 379

[56] References Cited

U.S. PATENT DOCUMENTS

| | | | |
|---|---|---|---|
| 2,968,967 | 1/1961 | Ross, Jr. . | |
| 3,249,336 | 5/1966 | Brown et al. . | |
| 3,323,780 | 6/1967 | Erickson et al. | 254/303 |
| 3,346,082 | 10/1967 | Dean, Jr. . | |
| 3,463,278 | 8/1969 | Broeker et al. . | |
| 3,511,328 | 5/1970 | Webb . | |
| 3,529,702 | 9/1970 | Eckstein, Jr. . | |
| 3,539,046 | 11/1970 | Berg . | |
| 3,550,735 | 12/1970 | Olsen . | |
| 3,592,346 | 7/1971 | Brown | 254/361 X |
| 3,722,707 | 3/1973 | Hedeen et al. | 254/309 X |
| 3,764,111 | 10/1973 | Dummer | 254/361 |
| 3,885,656 | 5/1975 | Michling et al. . | |
| 3,895,699 | 7/1975 | Mita et al. . | |
| 3,901,478 | 8/1975 | Peterson . | |
| 4,024,935 | 5/1977 | Sugimoto . | |
| 4,033,553 | 7/1977 | Sugimoto . | |
| 4,037,823 | 7/1977 | Thaeter et al. | 254/360 |
| 4,076,219 | 2/1978 | Behrends et al. | 254/349 |
| 4,093,034 | 6/1978 | Curley et al. . | |
| 4,162,714 | 7/1979 | Correll . | |
| 4,175,727 | 11/1979 | Clarke . | |
| 4,275,870 | 6/1981 | Henneman et al. | 254/361 |

*Primary Examiner*—John M. Jillions
*Attorney, Agent, or Firm*—A. J. Moore; R. B. Megley

[57] ABSTRACT

One or more freefall systems for a crane or the like is disclosed, which system includes a protective circuit that includes three separate switches that must be closed before the winch can be placed in its freefall mode. A mode switch in the cab must first be closed, a brake pedal must be depressed to close a second switch, and a third switch must be held closed by the operator during freefall.

15 Claims, 9 Drawing Figures

AUXILIARY WINCH 12
FREE FALL WINCH 10
POWER DOWN
POWER UP
BRAKE 78 SPRING SET
CLUTCH 76 SPRING RELEASED

FREEFALL WINCH SYSTEM AND METHOD OF OPERATION

BACKGROUND OF THE INVENTION

1. Field of the Invention

The present invention relates to a freefall winch system and method of operation for a crane or the like, and more particularly relates to a freefall system having a protective circuit, which system is capable of operating in the freefall mode only after the protective circuit has been actuated in a particular sequence.

2. Description of the Prior Art

Cranes having winches which are capable of being placed in a freefall mode are disclosed in patents such as United States patents to Olsen U.S. Pat. Nos. 3,550,735; Sugimoto 4,024,935 and Sugimoto 4,033,553.

Other United States patents such as Eckstein, Jr. U.S. Pat. Nos. 3,529,702 and Berg 3,539,046 disclose winches controlled by clutches and brakes.

SUMMARY OF THE INVENTION

The freefall winch system includes one or a combination of winches on a crane or the like. Each freefall winch system is selectively controlled to operate in a power up—power down mode and in either a high speed or a low speed range; or may be operated in a freefall mode. Protective circuitry is provided which will permit initial use of the freefall system only after three switches are sequentially closed. The switches include a mode switch on the dash, a winch brake pedal switch which is closed by depressing the brake, and a button on one of the hydraulic levers in the cab which must be held closed by the operator during freefall. If two freefall winches are provided on the same crane, a second brake pedal is provided and the second pedal must be depressed before actuation of the button will place the associated winch in its freefall mode.

DESCRIPTION OF THE PREFERRED EMBODIMENT

Figure 1:
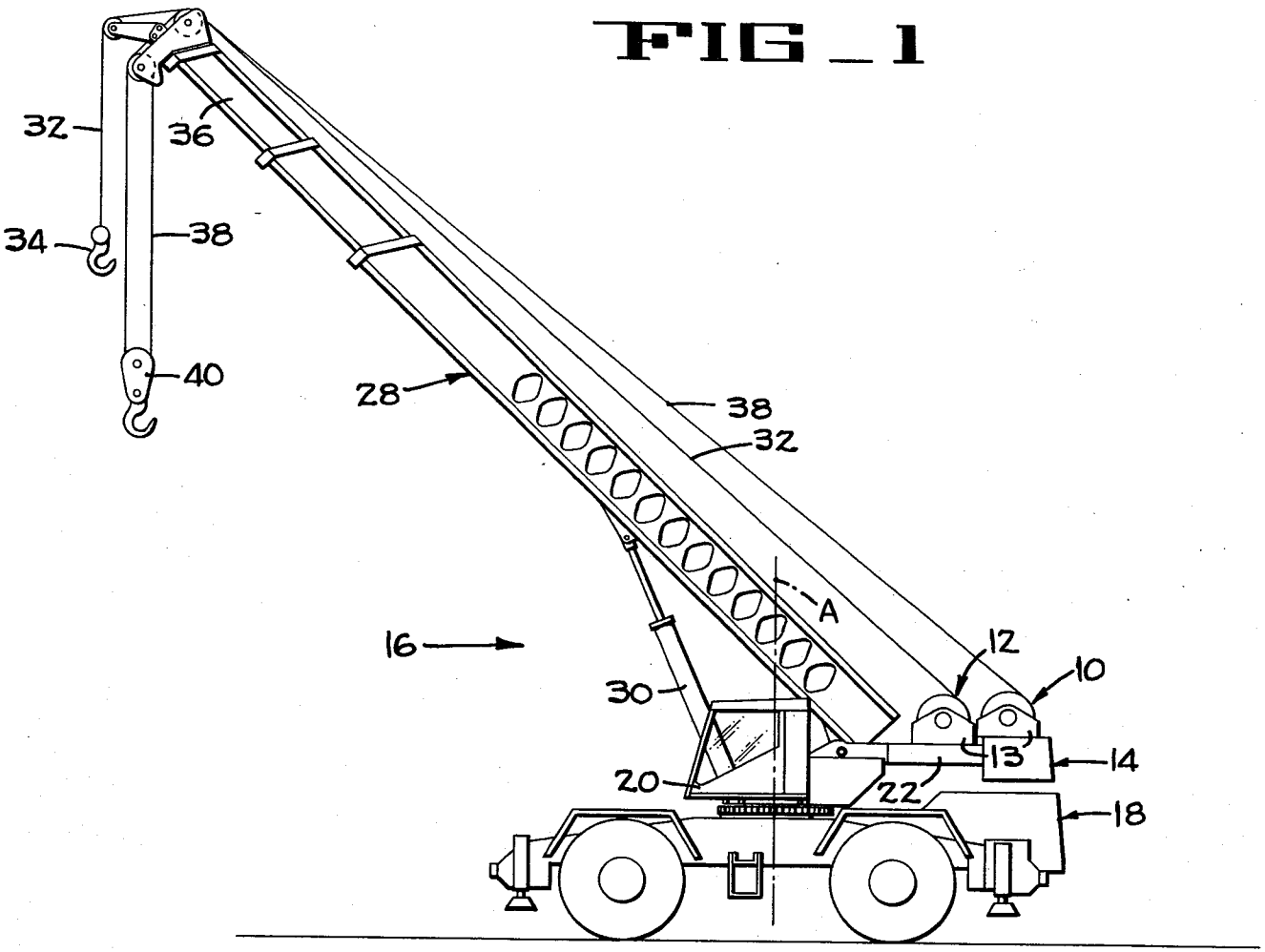
FIG. 1 is a diagrammatic elevation of a hydraulic crane provided with a whip line powered by an auxiliary winch, and a hook block powered by a main winch.

The freefall winch system 10 (FIGS. 2 and 3) is illustrated in combination with a well known power up—power down auxiliary winch 12, both of which include frames 13 which are mounted on the upper works 14 of a rough terrain crane 16 (FIG. 1). It will be understood, however, that the freefall system 10 can be mounted on other types of cranes (or other winch supporting mechanisms), and that a second freefall system may be substituted for the illustrated power up—power down auxiliary winch 12 if desired.

The crane 16 includes a power driven, wheel supported lower works 18, which lower works 18 supports the upper works 14 for rotation about a vetical axis A by conventional means (not shown). The upper works 14 includes an operator's cab 20, a frame structure 22, and the two winch systems 10 and 12 which are assembled on winch frames 13 as units so that different winch combinations may be used on the crane. The winch frames 13 are rigidly secured to the frame structure 22 of the upper works by bolts or the like. The upper works also supports a brake pedal 24 located in the cab 20 and connected to the freefall winch 10 by a linkage mechanism 26.

The upper works 14 (FIG. 1) pivotally supports a multi-section telescopic boom 28 which is raised and lowered by hydraulic cylinder 30. The boom 28 is extended and retracted in a conventional manner, and has a whip line 32 and hook 34. The whip line 32 is trained around and controlled by the auxiliary winch 12 and extends over sheaves on the tip section 36 of the boom. A cable or main hoist line 38 supports a hook block 40 and is trained around and controlled by the freefall winch 10 and sheaves on the tip section 36.

Figure 4:
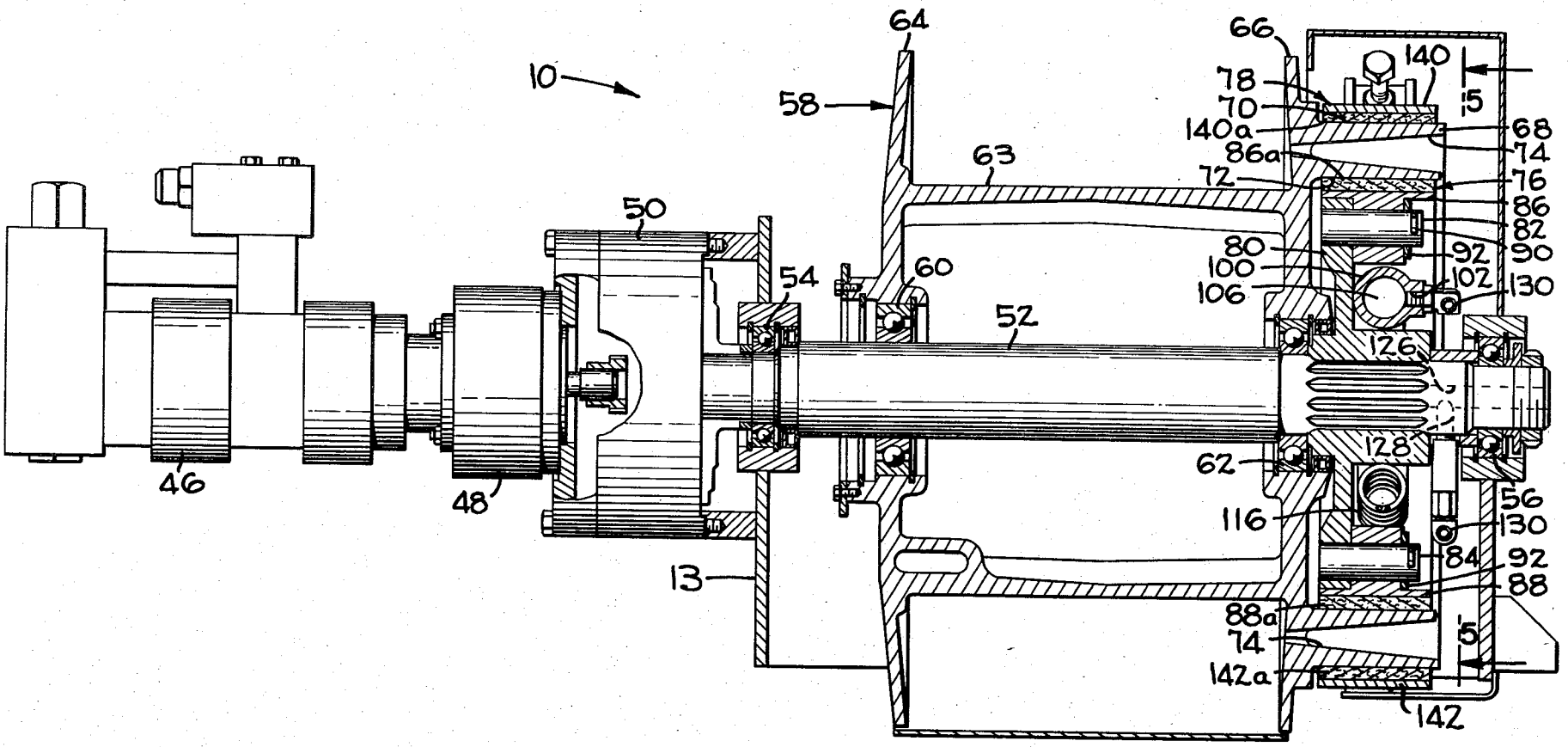
FIG. 4 is a transverse end elevation of the freefall winch with certain parts broken away and other parts shown in vertical section taken along lines 4—4 of FIG. 2.

As best shown in FIG. 4, the freefall winch 10 is powered by a hydraulic motor 46 which drives a multiple disc one-way clutch-brake 48 such as a well known Ausco clutch-brake. The one-way clutch-brake 48 automatically applies the brake and overruns the clutch when the motor 46 is driven in a direction which raises the load, i.e., in the power up drive direction. When lowering the load, the clutch is engaged and pilot pressure automatically releases the brake. The output of the automatic clutch-brake 48 is connected to the input of a gear reduction unit 50 which may be a Borg Warner Model 10,420 kit having a total gear reduction of 36.8 to 1.

The hydraulic motor 46, the one-way clutch-brake 48, and the gear reduction unit 50 are of conventional design and are well known in the art.

The output of the gear reduction unit 50 is coupled to a drum shaft 52, which shaft is rotatably supported on the winch frame 13 by bearings 54 and 56. A cable supporting freefall winch drum 58 is journaled on the drum shaft 52 by bearings 60,62. The drum 58 includes a cylindrical central portion 63 integrally formed with side flanges 64,66 for receiving and retaining the main hoist line or cable 38 (FIG. 1).

Figures 5, 6:
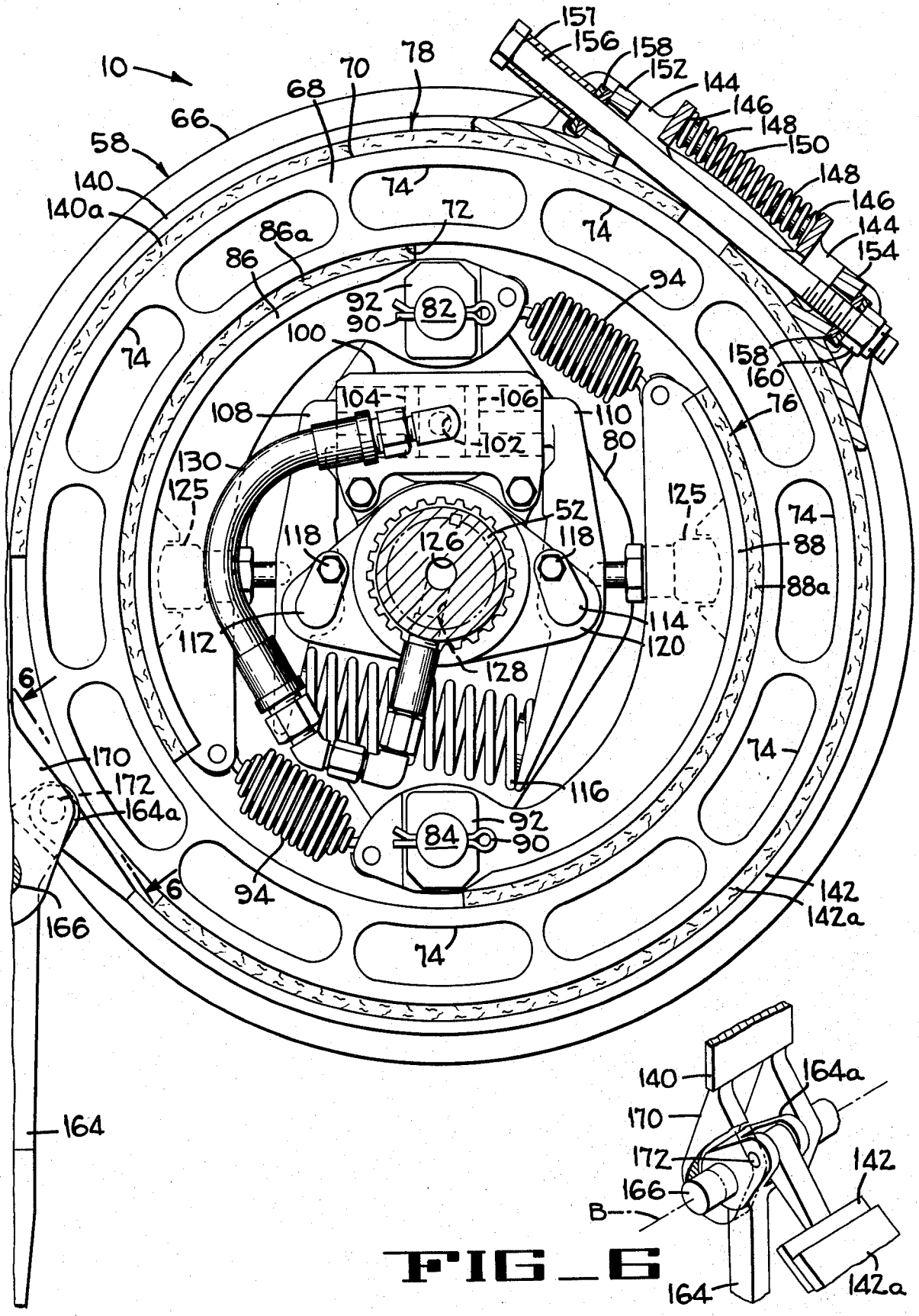
FIG. 5 is an enlarged end view of the winch drum taken along lines 5—5 of FIG. 4 illustrating the drum and its brake and clutch in elevation, certain parts broken away and other parts shown in section.
FIG. 6 is a perspective looking in the direction of lines 6—6 of FIG. 5 and illustrating the brake actuating lever system.

As best shown in FIGS. 4 and 5, the drum flange 66 has a axially extending annulus 68 formed integrally therewith, which annulus 68 defines an outer braking surface 70 and an inner clutching surface 72. Evenly spaced air cooling passages 74 are provided in the annulus 68 for dissipating heat resulting from frictional engagement by a clutch 76 and a brake 78.

The clutch 76 includes an annular clutch mount or spider 80 splined to the drum shaft 52 and having a pair of diametrically opposed, axially extending pivot pins 82,84 projecting outwardly therefrom. A pair of clutch shoes 86,88 each has one end portion pivoted to the associated pivot pin 82,84, respectively, and is held from axial movement by cotter pins 90 (FIG. 5) and washers 92. Extension springs 94 are pivotally connected between adjacent ends of the shoes 86,88 to urge the clutch shoe lining 86*a*, 88*a* out of engagement with the internal clutching surface 72.

The clutch 76 is actuated into clutching engagement with the drum by a hydraulic cylinder 100 having a central fluid inlet passage 102 and a pair of pistons 104,106 (diagrammatically illustrated in FIG. 5) which are moved outwardly against adjacent ends of clutch actuating levers 108,110, respectively. The levers 108 and 110 are pivoted to pins 112 and 114 and have their other ends urged outwardly by a compression spring 116. The pivot pins 112 and 114 are secured to and rotate with the clutch mount or spider 80 by capscrews 118 and a bracket 120 shown only in FIG. 5. Clutch shoe actuating mechanisms 125 are interposed between cavities in the associated clutch shoes 86,88 and the levers 108,110 for transmitting movement of the levers to the shoes in response to actuation of the hydraulic cylinder 100. The mechanisms 125 are adjustable to vary their lengths thereby compensating for clutch shoe wear.

A well known swivel joint (diagrammatically illustrated only in FIG. 7) is connected to a source of hydraulic fluid and to passages 126,128 in the drum shaft 52 for directing hydraulic fluid into the shaft. A conduit 130 (FIG. 5) is connected between the passage 128 and the passage 102 for directing fluid into and out of the clutch cylinder 100 under the control of an operator thereby engaging or disengaging the clutch 76 with the drum 58.

The brake 78 is a spring set—hydraulic release brake which includes a pair of brake bands 140,142 having brake linings 140*a*,142*a* selectively movable into braking engagement against the outer braking surface 70 of the drum 58. The upper portion of each brake band includes brackets 144 (FIG. 5) defining abutment surfaces 146 and centering pins 148 for receiving a compression spring 150. The brackets 144 also include second apertured abutments 152,154 for receiving an adjustment bolt 156. The bolt 156 extends through a tubular spacer 157, swivel washers 158, enlarged hole in the abutments 152,154 and thereby permits a limited amount of movement between the upper end portions of the brake bands. The bolt 156 is locked in adjusted position by a lock nut 160.

Figures 2, 2A:
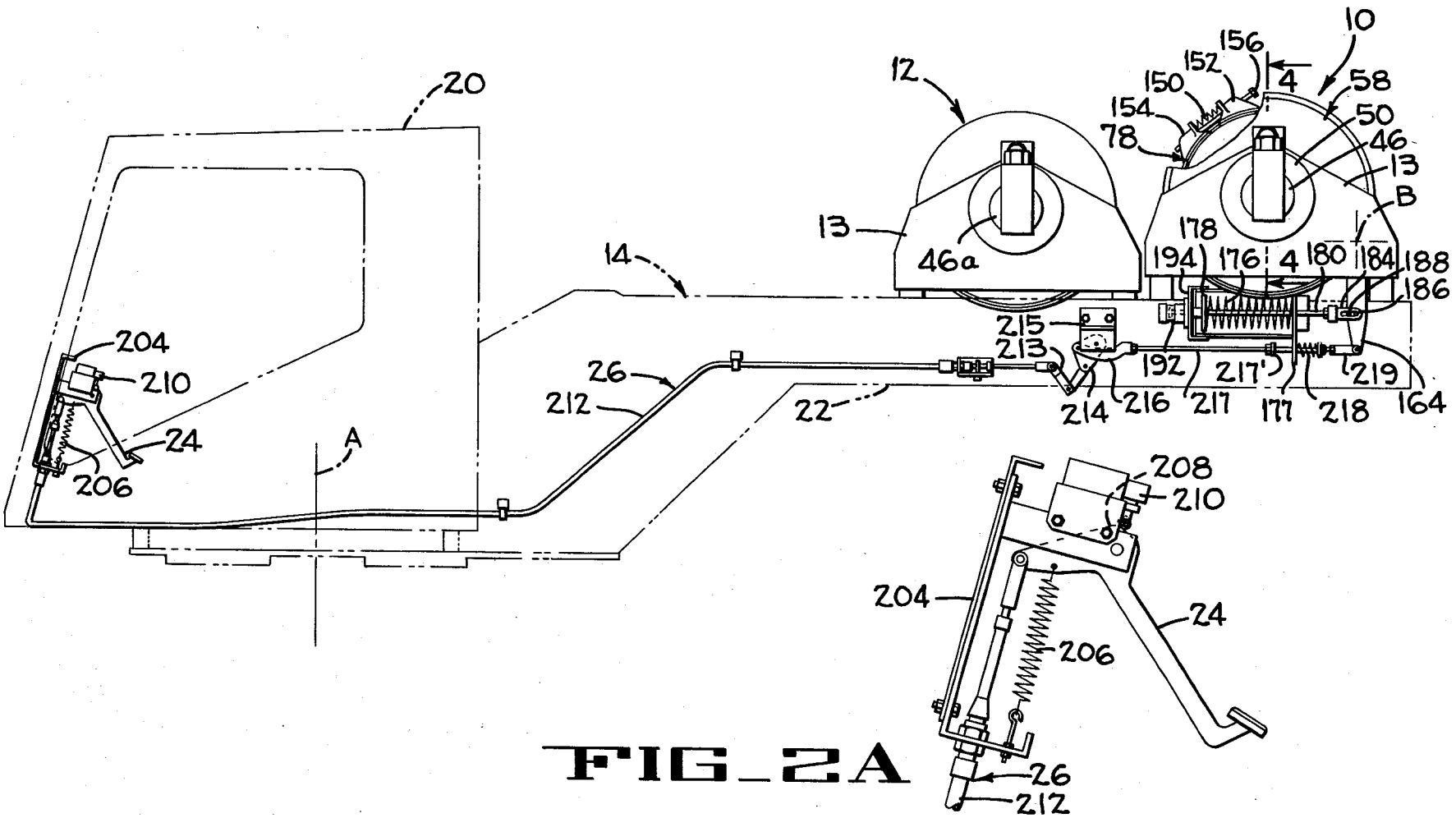
FIG. 2 is a schematic elevation with parts cut away illustrating the upper works and cab of the crane in phantom lines, and illustrating a standard power up—power down auxiliary winch assembly, and a freefall main winch assembly that is connected to a brake pedal.
FIG. 2A is an enlarged elevation of the brake pedal.

The other ends of the brake bands 140,142 are connected to a brake actuating lever or bell crank 164 (FIGS. 2, 5 and 6) which is supported by a pin 166 secured to the winch frame 13 for pivotal movement about axis B (FIG. 2). As best shown in FIGS. 5 and 6, the band 140 is pivotally connected to the pin 166 by a clevis 170 that is rigidly secured to the brake band 140. The other brake band 142 is pivotally connected to an offset portion 164*a* of the bell crank 164 of a pin 172. Thus, when the bell crank 164 is pivoted in a counterclockwise direction (FIGS. 5 and 6) or a clockwise direction as illustrated in FIG. 2, the brake bands will be tightened against the outer braking surface 70 of the freefall winch drum 58.

The brake 78 is resiliently held in engaged position to prevent rotation of the drum 58 by a compression spring 176 (FIG. 2) which is connected between a bracket 177 secured to the frame 22 of the upper works 14 and an abutment plate 178 secured to a threaded spring tie rod 180. The spring tie rod 180 is pivotally connected to the bell crank 164 by a yoke 184 secured on the tie rod and by a pin 186 that is received in slots 188 in the yoke. The tie rod 180 is connected to a piston of a brake releasing hydraulic cylinder 192 that is secured to the frame 22 of the upper works 14 by a bracket 194. When hydraulic fluid at a predetermined high pressure is directed into the cylinder 192, the spring tie rod 180 is moved to the right (FIG. 2) to compress the spring 176 thereby releasing the brake 78.

The manually operated foot brake linkage mechanism 26 is provided to override hydraulic release of the brake thus controlling (and stopping) rotation of the freefall drum 58 during the freefall operation. The manually operated foot brake linkage 26 is operated by the brake pedal 24 located in the cab 20 and the pedal is pivotally supported by an adjustable bracket 204 (FIG. 2A). The brake pedal 24 is held in the position illustrated in FIGS. 2 and 2A by a spring 206 connected between the pedal and the bracket. A cam 208 is formed on the upper surface of the pedal and closes a switch 210 in response to an operator depressing the pedal 24 at least about three-quarters of an inch for reasons to be described later.

Figure 3:
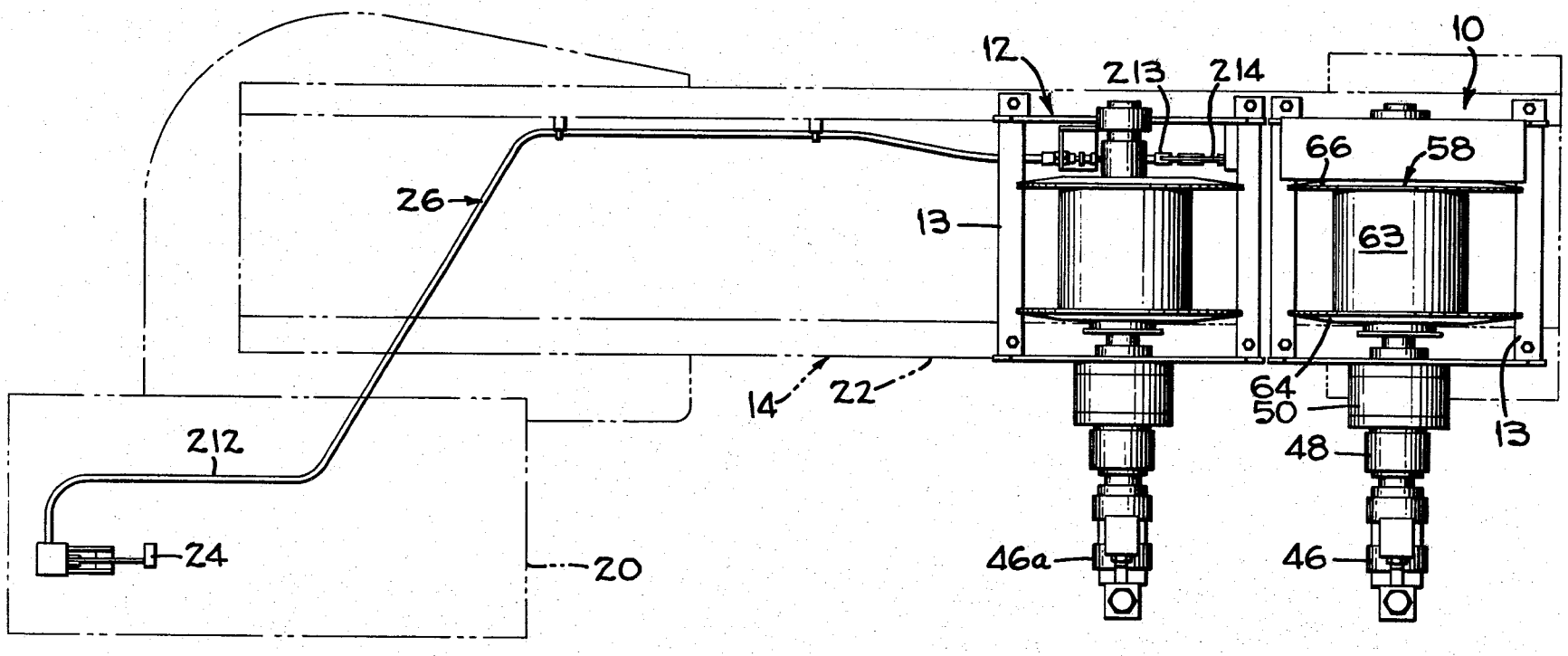
FIG. 3 is a plan view of the structure illustrated in FIG. 2.

A sheathed, push-pull cable 212 is included in the linkage mechanism 26 and has its sheathing secured to the bracket 204 and to the frame 22 of the upper works 14 as shown in FIGS. 2 and 3. The push-pull portion of the cable is connected between the brake pedal 24 and one end of a two-piece pivot linkage 213 which is shown in its slack position in FIG. 2. The other end of the pivotal linkage 213 is pivotally connected to a cam link 214 that is pivoted to a bracket 215 secured to the frame 22 of the upper works 14. The cam link 214 is also pivotally connected to a clevis 216 which is screwed on one end of a brake rod 217. The brake rod 217 extends through an aperture in the bracket 177 and has a return spring 218 mounted thereon. The other end of the brake rod 217 is secured to a clevis 219 which is pivotally connected to the lower end of the brake actuating bell crank 164 by a pin.

The return spring 218 is compressed between the bracket 177 and a pair of locknuts secured to the rod 217. A stop nut 217' is also secured to the brake rod 217 on the other side of the bracket 177 and is located on the rod 217 so that it will abut the bracket 177 when the brake 78 is released shifting the two-piece pivotal linkage into a linear position, i.e., in a tight position with all three pivot axes lying in a common plane substantially in alignment with the rear end portion of the push-pull cable 212. Accordingly, when the operator applies foot pressure on the brake pedal 24, the lower portion of the brake actuating bell crank 164 will immediately move to the left (FIG. 2) and the pin 186 will also move to the left within the slots 188 in the brake rod clevis 184. Thus, the operator can manually engage or disengage the brake 78 as required during freefall by depressing or releasing pressure on the brake pedal 24 without altering the position of the spring 176.

The operation of the freefall winch system 10 of the present invention will be described in conjunction with a hydraulic circuit 220 of FIG. 7 and an electrical circuit 222 of FIG. 8.

Hydraulic power for operating and controlling the main freefall winch 10 and the auxiliary winch 12 is provided by a main pump 224 (FIG. 7) which is driven by an engine (not shown) at about 2800 revolutions per minute to provide a capacity of about 73 gallons per minute at a pressure of about 2750 pounds per square inch. A driven variable displacement piston pump 226 provides a constant control pressure of about 1500 pounds per square inch for the freefall winch control functions.

The pumps 224,226 and their reservoir or sump S are located on the lower works of the crane and accordingly the high pressure fluid and the low pressure fluid returning to the sump S must flow through separate passages C-C, D-D and E-E in a well known rotating joint 228 in order to pass between the relatively rotatable lower works 18 (FIG. 1) and the upper works 14.

The circuit for the freefall winch 10 when operated in the power up—power down mode by hydraulic motor 46, which powers the freefall winch 10, will first be described.

Hydraulic fluid is drawn from the sump S by main pump 224. Pump 224 directs high pressure fluid through conduit 230, through passage C-C in rotating joint 228, through conduit 232 and past check valve CV1 into manually operated four-way auxiliary winch valve V1 which prevents passage to the winch motor when in the illustrated neutral position. Fluid then flows through a neutral passage 234 in valve V1, through conduit 236, through passage 238 in freefall winch valve V2 and returns to sump through conduits 240,246, passage D-D in rotating joint 228, and conduit 248 to sump S. When system pressure reaches about 2750 psi, the pressure in conduit 232 opens spring loaded relief valve RV1 by pressure from pilot line 242. High pressure fluid then flows through the relief valve RV1, conduit 244, through sump return conduit 240, conduit 246, passage D-D in rotating joint 228 and conduit 248 to the sump S.

Figure 7:
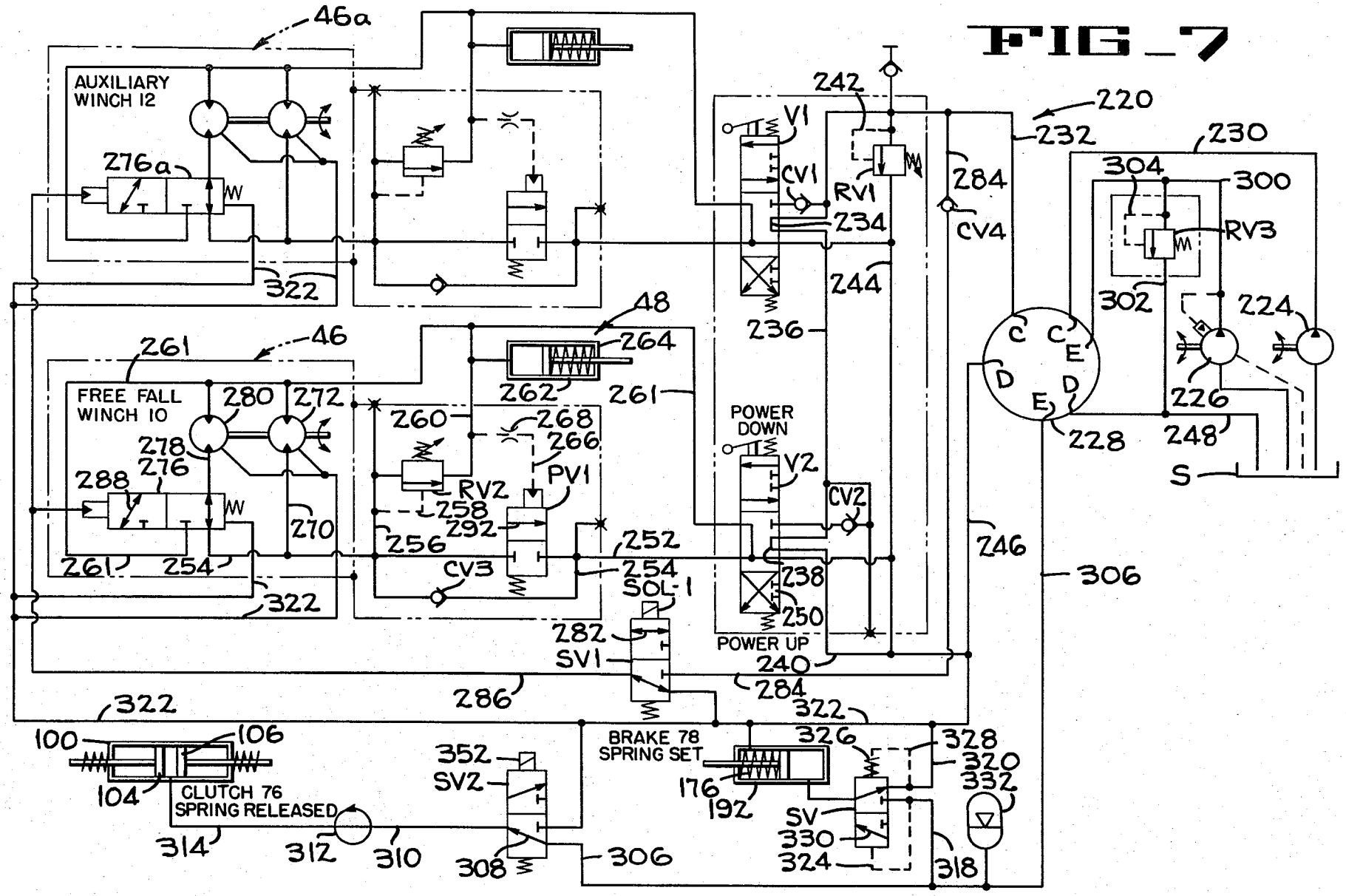
FIG. 7 is a hydraulic control circuit for the freefall main winch and the auxiliary power up—power down winch.

In order to drive the freefall winch 10 (FIG. 1) in a direction which will raise the hook block 40, the valve V2 is manually shifted into cross passage position 250 (FIG. 7). High pressure fluid then flows from conduit 236 past check valve CV2, through a cross passage in the core of the valve V2, through conduits 252 and 254, through check valve CV3 in conduit 254, and into conduit 256. If fluid pressure is excessive and reaches about 3000 psi in conduit 256 and in pilot line 258, pilot operated relief valve RV2 opens directing fluid therethrough and through conduits 260,261, and valve V2 for return to the sump S.

During the power up mode, the pressure in conduit 260 acting on hydraulic cylinder 262 is insufficient to release the brake (against the urging of the spring 264) of the one-way clutch-brake 48 (FIG. 3) permitting the one-way clutch to override the brake as previously described. Also, the relatively low fluid pressure in conduit 260 enters pilot line 266 and flow resistor 268 but is insufficient to open pilot operated valve PV1 at this time. Accordingly, the high pressure fluid enters the hydraulic motor 46 from conduit 254.

A portion of this fluid flows through conduit 270 into and through a first gear set 272 of motor 46 for discharging to conduit 261. Another portion of the high pressure fluid flows through a parallel passage in the low speed—high speed valve 276, through conduit 278, and through a second gear set 280 of motor 46 for discharge at low pressure into conduit 261.

The low pressure fluid in conduit 261 then passes through a second cross passage in valve V2 for return to sump S through previously described circuits.

As illustrated in FIG. 7, the high speed—low speed valve 276 is in its low speed range since approximately one-half (depending upon the gear ratios) of the fluid passes through each gear set 272,280. If it is desired to shift the valve into its high speed range for accommodating light loads, the operator closes a switch 281 (FIG. 8) in the cab to energize a solenoid SOL-1 (FIG. 7) which shifts the core of the solenoid valve SV1 to place cross passage 282 in communication with conduits 284 and 286. High pressure fluid then flows from conduit 232, through conduit 284 and check valve CV4 therein, through passage 282 in solenoid valve SV1, through conduit 286 and applied pressure to the core of the valve 276 so that its diagonal passage 288 establishes flow communication between conduits 261 and 278. Thus, fluid in the gear set 280 is merely recirculated in a closed path and imparts no power to the motor 46. The full volume of the fluid flowing in conduit 270 then flows through gear set 272 and drives the motor 46 at a speed range that is approximately twice that of the slow speed range.

In order to power down the hook block 34, the manual valve V2 is shifted to the parallel passage position. High pressure fluid then flows from conduit 236, through check valve CV2, through a parallel passage in valve V2, through conduits 261,260, to shift the piston in the hydraulic cylinder 262 against the urging of spring 264 thereby releasing the brake of the one-way clutch-brake 48. High pressure in conduits 260 and 266 also shifts valve PV1 to its open position.

High pressure fluid in conduit 261 then divides and flows through gear sets 272 and 280 of the motor 46 to drive the motor and the winch 10 in a power down direction in the slow speed range, assuming that solenoid SOL-1 is de-energized and valve 276 is in the illustrated position. The low pressure fluid discharging from gear set 280 flows through a conduit 278, the parallel passage in valve 276 and combines with the flow of fluid in the conduit 270 from gear set 272. The low pressure fluid then flows through conduit 254, the passage 292 in valve PV1, conduit 252, and through a parallel passage in valve V2 for return to the sump S through previously described circuits.

If the hydraulic motor 46 is to be powered down in its high speed range, the switch 281 (FIG. 8) in the cab is closed to energize solenoid SOL-1 thereby shifting passage 288 of valve 276 into communication with conduits 261 and 278 thereby causing all (rather than about one-half) of the high pressure fluid in conduit 254 to pass through the gear set 272 which approximately doubles the powered down speed range. It will, of course, be understood that partial of full actuation of manual control valve V2 located in the cab will permit different speeds within each speed range in both the up and down directions.

The circuit for the hydraulic motor **46*a* of the auxiliary winch 12 is substantially the same as that disclosed above in regard to the power up—power down circuit for the freefall winch 10. Thus, the circuit for the auxiliary winch 12** will not be described in detail, and parts of the auxiliary circuit which are equivalent to those of the main circuit will be assigned the same numerals followed by the letter "a".

It will be noted that the single solenoid operated valve SV1 is provided and thus simultaneously shifts the high speed—low speed valves 276a of the auxiliary circuit and valve 276 of the main circuit in response to actuation of the electrical switch 281 (FIG. 8) in the cab.

In order to switch the freefall system 10 from its power down mode described above to its freefall mode, the electrical protective control circuit 222 (FIG. 8) must be operated in a specific sequence before the hydraulic components that permit freefall may be placed in operation.

The freefall hydraulic components receive their hydraulic fluid from variable displacement piston pump 226 (FIG. 7) which provides hydraulic fluid at a constant pressure of about 1500 psi. The pump 226 draws fluid from sump S and directs it through conduit 300. A pilot operated relief valve RV3 in conduit 302 is opened to return fluid to the sump S through conduit 248 in the event pressure in pilot line 304 becomes excessive. When operating at the proper pressure, fluid from conduit 300 flows through passage E-E in the rotating joint 228, through conduit 306, through a diagonal passage 308 in solenoid operated freefall valve SV2, through conduits 310 and through the swivel joint 312 that is connected to the drum shaft 52 (FIG. 4). The output of the swivel joint 312 is connected to the freefall clutch cylinder 100 by a composite circuit 314 (FIG. 7) thereby hydraulically holding the clutch 76 engaged in the power up—power down mode when the valves are positioned as illustrated in FIG. 7. It will be understood that the composite circuit 314 includes the passages 126,128 and the conduit 130 illustrated in FIGS. 4 and 5.

The previously described brake 78 (FIG. 2) is held applied by the spring 176 (diagrammatically illustrated in FIG. 7) when the machine is turned off or the hydraulic pressure in the brake release cylinder 192 is below normal which is about 1200 psi. The brake 78 must be hydraulically released before freefall can take place.

Release of the brake 78 is accomplished with the aid of a pressure sequencing shuttle valve SV that is connected by conduits 318 and 320 to the conduit 306 and to a sump return conduit 322, respectively. A pilot line 324 connected between the conduit 318 and one end of the shuttle valve SV, opposes the force exerted by a spring 326 and by low pressure in a pilot line 328 connected between the other end of the shuttle valve and conduit 320. When pressure is in excess of about 1200 psi in conduit 306 and pilot line 324, the core of shuttle valve SV will be shifted placing passage 330 in communication with the brake release cylinder 192 thereby releasing the brake 78.

An accumulator 332 is connected to conduit 306 and is precharged at about 1000 psi to protect the freefall circuit from undue pressure surges and to minimize momentary pressure drops when solenoid valve SV2 is energized. Such a momentary pressure drop would tend to momentarily enage the brake 78.

It will be noted that the sump return conduit 322 is connected to the cases of the gear sets 272,280, 272a,280a and to the high speed—low speed valves 276 and 276a for returning leakage oil to the sump S.

An important feature of the invention is the provision of the protective electrical circuit 222 (FIG. 8) which will permit the operator to place the freefall winch in its freefall mode only after sequentially performing certain functions.

For example, if a concrete bucket has been raised by the freefall winch 10 and dumped, the empty bucket can be lowered either by powering it down with the winch 10 or by placing the winch 10 in its freefall mode and stopping the empty bucket by means of a foot actuated brake before it reaches the ground.

In order to initiate freefall, the operator must first close a mode switch 340 (FIG. 8) located in the cab 20 of the crane. He must then place his foot on brake pedal 24 and depress the pedal about three-quarters of an inch or more and maintain the pedal depressed thereby causing cam 208 (FIGS. 2A and 8) to close the switch 210 until the brake pedal 24 is released. With switches 340 and 210 closed, an electrical circuit 341, which includes main lines 342 and 344 connected to a battery 346 and a relay coil R1, is partially prepared or closed thereby closing relay contact R1-1 and R1-2. However, a third protective switch 350 must be closed before the circuit 341 is closed and solenoid 352 (FIGS. 7 and 8) of freefall solenoid valve SV2 is energized.

A control button 353 for actuating switch 350 is preferably located on a hydraulic control lever 354 which controls hoisting of the boom 28 (FIG. 1) and is of the type wherein the button 353 must be held closed by thumb pressure acting through a sheathed wire or the like. Thus, the switch 350 is in effect a "deadman's switch" since it will automatically open the circuit 341 to the solenoid 352, and thus hydraulically apply the clutch 76, when the button 353 is released for any reason.

Energization of solenoid 352 shifts the core of the solenoid valve SV2 (FIG. 7) thereby venting fluid in the clutch cylinder 100 to sump S which disengages the clutch 76. Assuming that hydraulic pressure in brake cylinder 192 is greater than about 1200 psi, which is the normal condition when the crane is operating, the freefall winch system 10 is placed in its freefall mode.

Although the freefall brake has been hydraulically released as above described, the operator has complete control of the rate of freefall and the height at which the load will be stopped. This control is achieved by further depressing the brake pedal 24 to frictionally engage the brake with the drum 58 to slow down and stop the drum as required.

In order to again raise the concrete bucket (or other article), the brake pedal 24 (FIG. 8) and thumb actuated button 353 are merely released thereby de-energizing relay R1 and solenoid 352 placing the freefall winch system in its power up—power down mode. The operator then actuates the manual valve V2 (FIG. 7) placing the cross passage portion 250 of the valve core in the hydraulic circuit. If the crane is to be operated so that a plurality of power up, freefall down cycles are performed, the mode switch 340 in the cab may remain closed during the plurality of cycles. Thus, with the mode switch 340 closed, repeated freefall and power-up operations may be performed by first closing switch 210 with foot pressure on pedal 24, applying thumb pressure on button 353 to close switch 350 thereby initiating freefall, then stopping the freefall by pressure on the pedal 24, releasing the button 353 to cause the clutch to engage the drum 58, and finally releasing the brake pedal 24 preparing the system for the next power-up operation.

As mentioned previously, a second freefall winch 10 may be substituted for the standard power up—power down winch 12 thus providing two freefall winches 10 on the crane 16. The hydraulic circuit for the second freefall winch will not be fully shown since it includes the circuit for the power up—power down winch 12, and includes a second freefall circuit that is identical to the previously described freefall circuit for the freefall winch 10.

Figure 8:
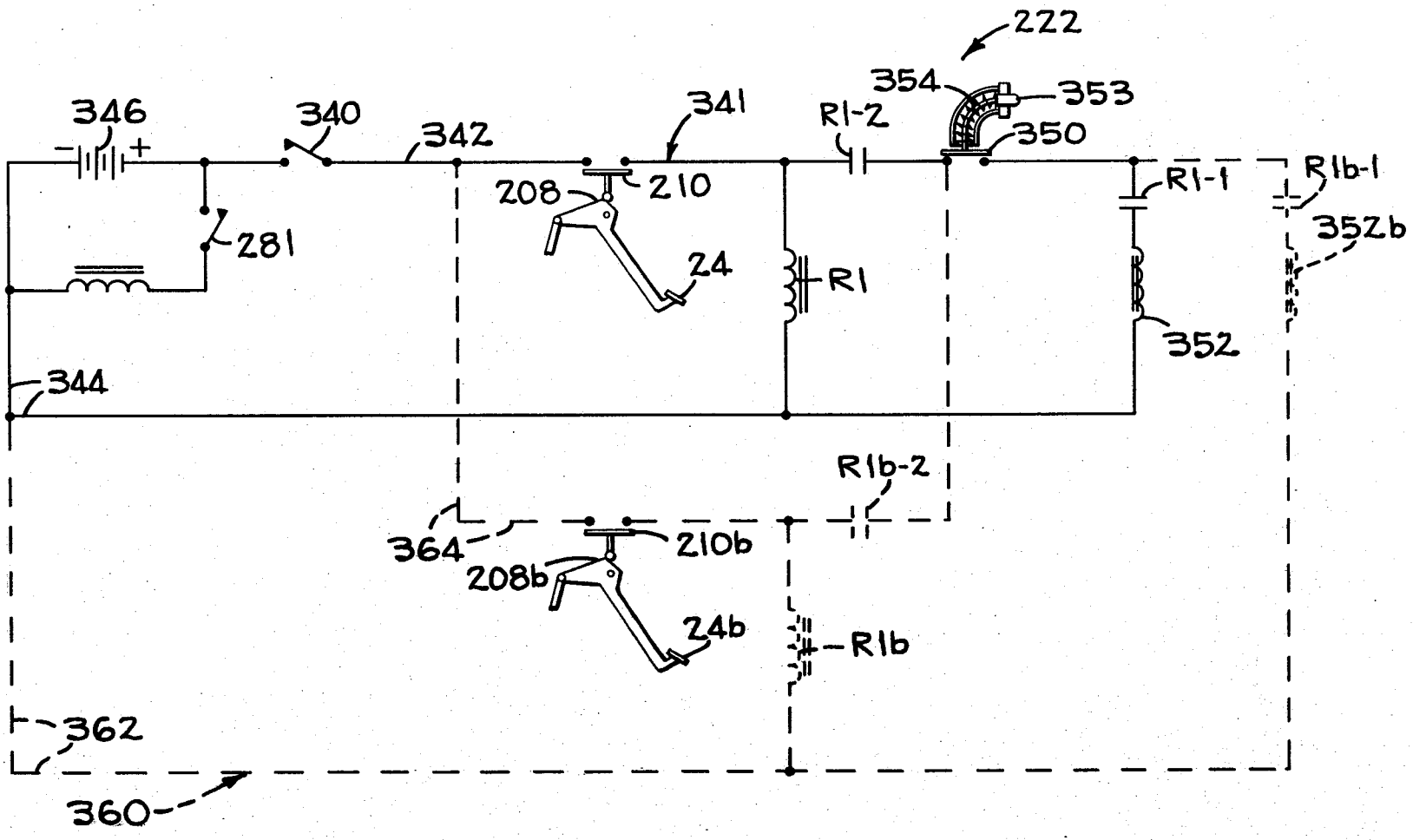
FIG. 8 is an electrical circuit illustrating the electrical controls for operating the freefall main winch in solid lines, and a second circuit in dotted lines for operating a second freefall auxiliary winch system in place of the power up—power down winch.

The electrical protective circuit 360 illustrated in dotted lines in FIG. 8 is provided to control the actuation of the second freefall system 10. The second electrical circuit 360 receives power from the battery 346 through mode switch 340, when closed, and main lines 362 and 364. A second brake pedal **24*b* includes a cam 208*b* which closes switch 210*b* when the brake pedal 24*b* is depressed three-quarters of an inch (or more) thereby energizing relay R1b which closed relay contacts R1b-1 and R1b-2. When the operator holds switch 350 closed with his thumb, a circuit is established which energizes solenoid 352*b*. Energization of solenoid 352*b* releases the clutch of the second free-fall winch thus placing the second freefall winch in the freefall mode as described above in regard to main freefall winch 10. It will be noted that when two freefall systems are used, the operator must not only depress the button 353 to close the switch 350 but must also depress the correct brake pedal 24 or 24*b* in order to place the main freefall winch 10 or the second freefall winch, respectively, in the freefall mode. It will also be noted that the protective circuit must be operated sequentially. The mode switch 340 must first be closed, the appropriate brake pedal 24 or 24*b* must be depressed, and then the button 353 must be depressed in order to close switch 350 thereby placing the freefall winch or winches 10** in their freefall modes.

From the foregoing description it is apparent that either one or two freefall winch systems may be used with a single crane or the like, and that an improved sequentially operated protective circuit is provided to assure that the operator has immediate brake control of the circuit before freefall will take place. The protective circuit requires the closing of three switches in sequence, and further requires that the operator has his foot on and at least lightly presses the brake pedal to close a switch before freefall can take place.

Although the best mode contemplated for carrying out the present invention has been shown a and described, it will be apparent that modification and variation may be made without departing from what is regarded to be the subject matter of the invention.

What is claimed is:

1. In a freefall system for a crane or the like, said system including a frame, a drum shaft journaled on said frame, a drum journaled on said shaft and having a cable trained therearound for selectively raising and lowering a load, clutch means for selectively interconnecting the drum and the drum shaft, a clutch releasing circuit having switch means therein, brake means for selectively resisting and allowing rotation of said drum relative to said frame, means for selectively driving said drum shaft in load raising and load lowering directions: the improvement which comprises first control means for releasing said brake means; depressible manually operated brake actuating means for overriding said first control means for applying a drum braking force; and second control means including said switch means in said clutch releasing circuit for releasing said clutch, said second control means being effective to release said clutch means when said manual brake actuating means is partially depressed and when said switch means in said clutch releasing circuit is manually held closed.

2. An apparatus according to claim 1 wherein said depressible manually operated brake actuating means includes a brake pedal which must be depressed by the foot of an operator.

3. An apparatus according to claims 1 or 2 wherein said switch means in said clutch relasing circuit is a spring loaded switch which must be held closed by the hand of an operator during freefall.

4. An apparatus according to claim 1 wherein said depressible manual brake actuating means includes a brake pedal which must be depressed at least a predetermined distance for partially closing said clutch releasing circuit, wherein said switch means is a spring loaded switch which must be held closed to complete said circuit for releasing said clutch, and wherein said brake pedal must be depressed by an operator's foot prior to holding said switch means closed.

5. An apparatus according to claim 4 and additionally comprising a mode switch in said clutch releasing circuit, said circuit being actuated to release said clutch by sequentially closing said mode switch, depressing said brake pedal, and holding said switch means closed.

6. An apparatus according to claims 1 or 4 wherein said brake means includes lever means pivotally mounted on said frame for engaging and releasing said brake in response to pivotal movement in opposite directions, a brake actuating tie rod connected to said lever means through a lost motion connection, resilient means connected between said frame and said tie rod for engaging said brake means, and a hydraulic cylinder connected between said frame and said rod for disengaging said brake means; and wherein said first control means includes a hydraulic circuit and said cylinder, said first control means releasing said brake in response to hydraulic pressure in said circuit and in said cylinder being at a normal operating pressure.

7. An apparatus according to claim 6 wherein said manual brake actuating means comprises a brake pedal resiliently urged into a brake releasing position, a brake rod pivotally connected to said lever means, cam means pivotally supported by said frame and connected to said brake rod, a push-pull linkage connected to said brake pedal, a pivotal lost motion linkage connected between said push-pull linkage and said cam means for providing slack in said linkage, said pivotal linkage being disposed in a non-linear slack position when the brake means is engaged by said resilient means and a linear tight position when the brake means is disengaged for providing a tight connection between the brake pedal and said lever means when said brake has been hydraulically released.

8. An apparatus according to claim 2 wherein said second control means includes an electrical circuit and a hydraulic circuit having an electrically operated valve therein; said electrical circuit including said switch means which is closed by depressing said brake pedal, and a second resiliently opened switch which is manually held closed during freefall, said electrical circuit being closed to shift said valve to a clutch releasing position in response to sequentially closing said first and second switches.

9. An apparatus according to claim 8 wherein said electrical circuit additionally comprises a mode switch which must be closed prior to said first and second switches for initiating freefall.

10. An apparatus according to claims 8 or 9 wherein two freefall systems are provided, said electrical circuit for each system including a single resiliently open second switch which is responsive to both systems, and a separate brake pedal and brake actuated first switch for each system which first switch is closed by depressing the associated brake pedal for releasing the clutch associated with that freefall system.

11. A method of controlling a freefall winch system that includes a drum shaft journaled on a frame and a drum journaled on the shaft and having a flexible load carrying means trained therearound, a normally engaged clutch disposed between the shaft and the drum, a brake disposed between the drum and the frame and partially controlled by a brake pedal, and a protective freefall circuit for controlling the load during freefall: said method comprising the steps of hydraulically releasing the brake, rotating the shaft and said drum to raise the load, manually depressing the brake pedal for overriding the hydraulically released brake and for partially closing the freefall circuit by closing a portion of the circuit, manually holding another portion of said circuit closed against an opposing resilient force for releasing the clutch, maintaining control over the rotating drum and stopping the load prior to reaching the ground during freefall by manually applying adequate braking forces to the drum by pressure on the pedal, releasing manual pressure on the second portion of the circuit to deactivate the circuit and engage the clutch, and releasing the brake pedal.

12. A method according to claim 11 and additionally including the steps of sequentially actuating a mode switch for closing a first portion of said freefall circuit at least when the crane is first intended to be operated in its freefall mode, thereafter closing the brake pedal control portion of the circuit, and then closing said another portion of the circuit which activates the freefall circuit and effects release of said clutch.

13. A method according to claims 11 or 12 wherein said clutch releasing step includes the step of releasing the clutch by hydraulic pressure against the urging of a resilient force that normally holds the clutch engaged.

14. A method according to claims 11 or 12 wherein the brake is hydraulically released in response to normal hydraulic brake releasing system pressure being present thereby rendering the freefall system inoperative when the hydraulic system is not operating or a hydraulic line is broken.

15. A method according to claim 14 wherein said normal brake releasing system pressure is about 1200 psi.

* * * * *